US008464364B2

(12) United States Patent
Hofeldt

(10) Patent No.: US 8,464,364 B2
(45) Date of Patent: Jun. 18, 2013

(54) GATED GLOVE POCKET

(76) Inventor: Albert John Hofeldt, Miami Beach, FL (US)

( * ) Notice: Subject to any disclaimer, the term of this patent is extended or adjusted under 35 U.S.C. 154(b) by 2 days.

(21) Appl. No.: 13/373,147

(22) Filed: Nov. 7, 2011

(65) Prior Publication Data

US 2012/0117704 A1 May 17, 2012

Related U.S. Application Data

(60) Provisional application No. 61/456,861, filed on Nov. 15, 2010, provisional application No. 61/460,455, filed on Jan. 3, 2011.

(51) Int. Cl.
*A41D 19/00* (2006.01)

(52) U.S. Cl.
USPC ..... 2/160; 2/159

(58) Field of Classification Search
USPC ..... 2/158–162, 20
See application file for complete search history.

(56) References Cited

U.S. PATENT DOCUMENTS

| | | | | |
|---|---|---|---|---|
| 1,453,714 | A * | 5/1923 | Levinson | 2/18 |
| 1,750,180 | A * | 3/1930 | Marinsky | 2/160 |
| 1,970,081 | A * | 8/1934 | Eisendrath | 126/204 |
| 2,103,594 | A * | 12/1937 | Murray | 2/160 |
| 2,421,412 | A * | 6/1947 | Dodge | 2/160 |
| 2,496,734 | A * | 2/1950 | Macreadie | 2/160 |
| 2,603,790 | A * | 7/1952 | Boehm-Myro | 2/158 |
| 4,587,672 | A * | 5/1986 | Madnick et al. | 2/158 |
| 4,670,909 | A * | 6/1987 | Forrester | 2/160 |
| 4,805,242 | A * | 2/1989 | Bolton | 2/160 |
| 4,862,521 | A * | 9/1989 | Mann | 2/160 |
| 5,517,693 | A * | 5/1996 | Noonan | 2/159 |
| D397,837 | S * | 9/1998 | Redwood et al. | D2/614 |
| 6,233,742 | B1 * | 5/2001 | Yungkurth | 2/160 |
| 7,086,093 | B2 * | 8/2006 | Carey et al. | 2/159 |
| 7,451,496 | B2 * | 11/2008 | Carey et al. | 2/160 |
| 7,644,448 | B2 * | 1/2010 | Grilliot et al. | 2/161.6 |
| 2003/0154537 | A1 * | 8/2003 | Carey et al. | 2/160 |
| 2004/0244090 | A1 * | 12/2004 | Langer | 2/160 |

* cited by examiner

*Primary Examiner* — Richale Quinn

(57) ABSTRACT

A pocketed device for housing cushioning located on the palm of a glove that has a gate which allows the padding material to be removed and replaced with the same or different material.

1 Claim, 10 Drawing Sheets

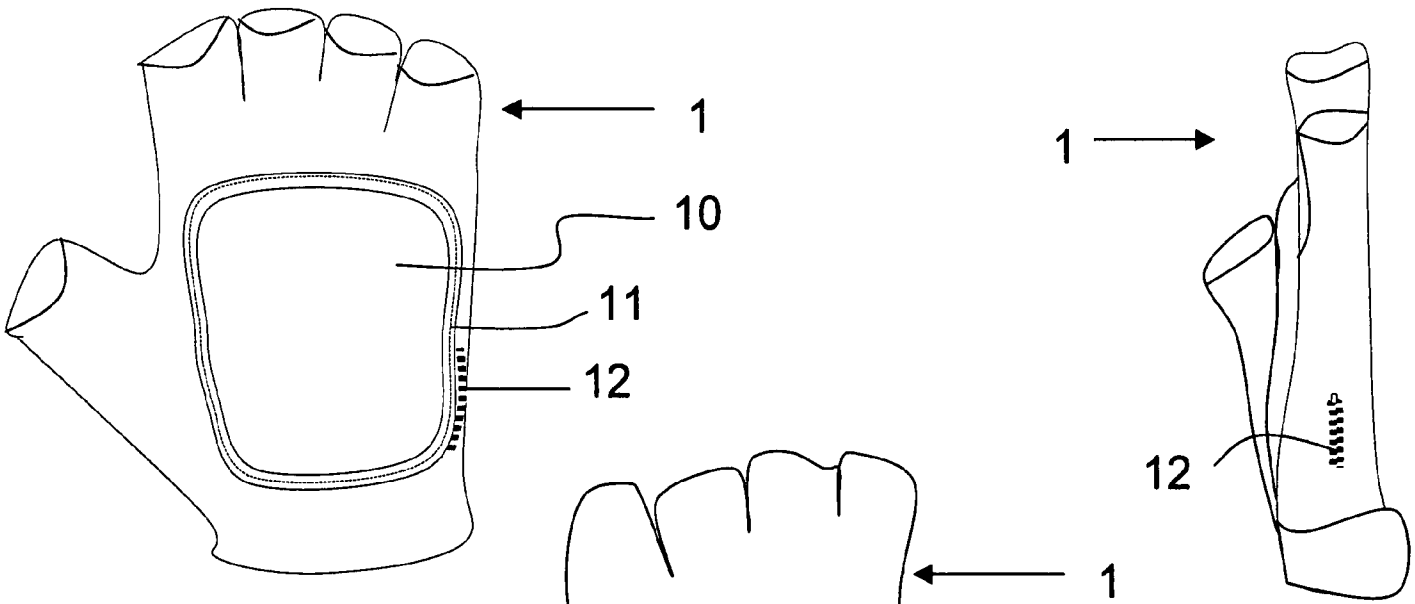
FIG. 1
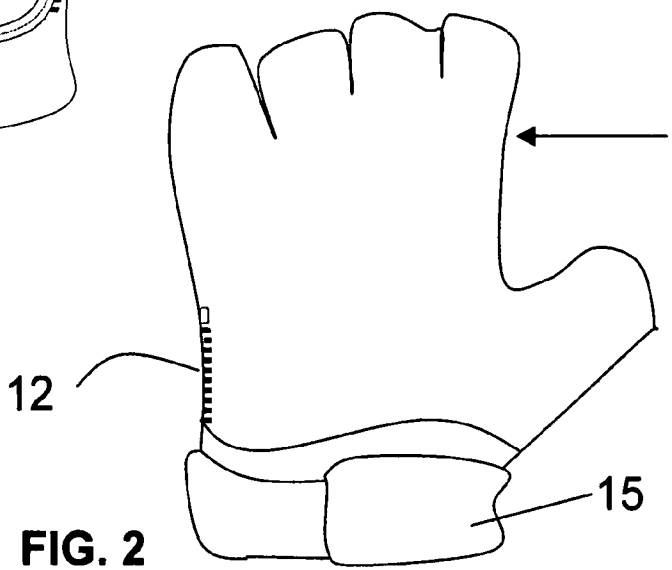
FIG. 2
FIG. 3

GATED GLOVE POCKET

CROSS REFERENCE TO RELATED APPLICATIONS

1. Provisional patent application 61/456,861 dated Nov. 15, 2010: Glove pocket with access for exchanging padding material.
2. Provisional patent application 61/460,455 dated Jan. 3, 2011: Glove pocket with access for exchanging padding material.

STATEMENT REGARDING FEDERALLY SPONSORED OR DEVELOPMENT

Not Applicable

DESCRIPTION OF ATTACHED APPENDIX

Not Applicable

BACKGROUND OF THE INVENTION

My invention is a gated glove pocket for housing padding that opens to allow the exchange of the cushioning material. The gate in the pocket of a glove provides access for removing and replacing the padding material with the same or a different padding material. Glove wearers differ in their desired characteristics for glove padding. Many options exist in terms of the type of glove, the shape of the padding, the thickness of the padding, and the composition of the padding. Padding materials differ in hardness, surface contours, compressibility, shape, etc. Currently, a glove wearer must choose a glove containing a specific padding. Shape and cushioning characteristics can be varied with my invention which allows for the first time the ability to match preferred shape with the preferred cushioning characteristics. My invention would allow a wearer to change the padding in the glove to accommodate different riding, driving or working conditions.

BRIEF SUMMARY OF THE INVENTION

In accordance with a preferred embodiment of the invention, there is disclosed one or more pockets for a glove that has one or more openings or gates for the insertion and removal of cushioning material. Each pocket may have one or more compartments for housing padding. The gate may be folded material or mechanical fasteners, such as, snaps, clips, buttons, zipper, tension cords, and adhesive material. My gated pocket can be used for any type of glove, for example, work glove, exercise glove, weight lifting glove, driving glove, cycling glove, etc. My invention provides for the first time the means to choose a cushioning pad of the desired shape and cushioning characteristics to fit with the desired glove and to change the padding type to accommodate different cushioning needs.

BRIEF DESCRIPTION OF THE DRAWINGS

The drawings constitute a part of the specifications and include exemplary embodiments to the invention, which may be embodied in various forms. It is to be understood that in some instances various aspects of the invention may be shown exaggerated or enlarged to facilitate an understanding of the invention.

FIG. 1. Palm view of glove having an external pocket

FIG. 2. Top view of cycling glove showing zipper

FIG. 3. Side view of cycling glove showing side zipper

DETAILED DESCRIPTION

Figure 6A:
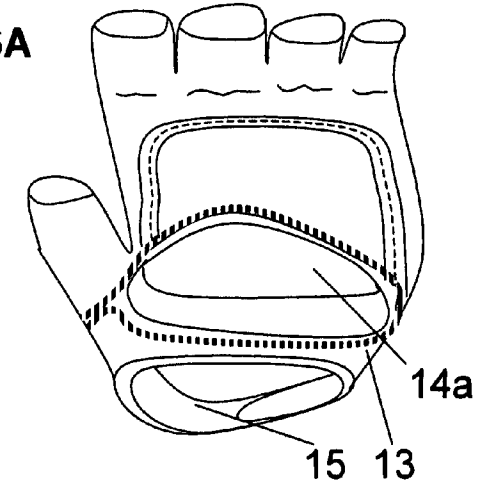
FIG. 6A. Palm view of glove showing pocket cavity

Detailed descriptions of the preferred embodiment are provided herein. It is to be understood, however, that the present invention may be embodied in various forms. Therefore, specific details disclosed within are not to be interpreted as limiting, but rather as a basis for the claims and as a representative basis for teaching one skilled in the art to employ the present invention in virtually any appropriately detained system, structure or manner. The drawing picture short finger cycling gloves but the pocket applies to any type of glove.

Figure 6B:
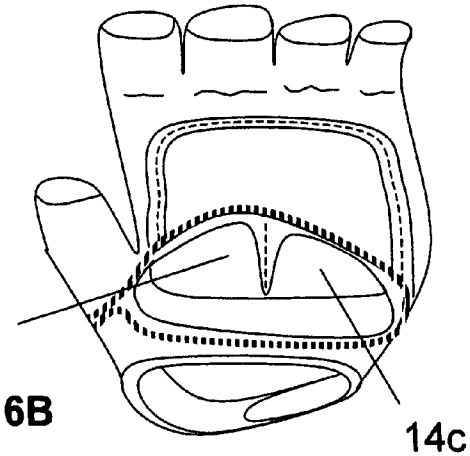
FIG. 6B. Palm view of glove showing two compartments
Figure 5:
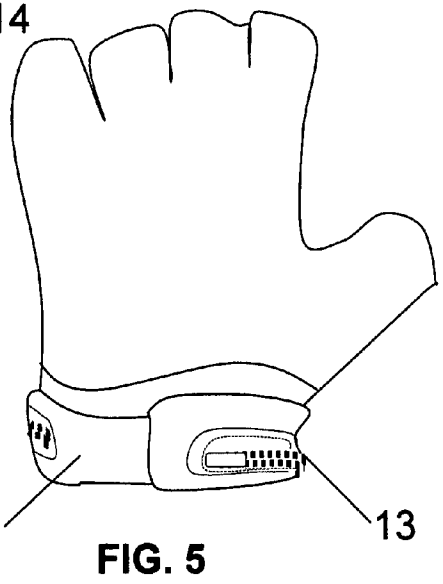
FIG. 5. Top view of cycling glove showing wrist zipper
Figure 4:
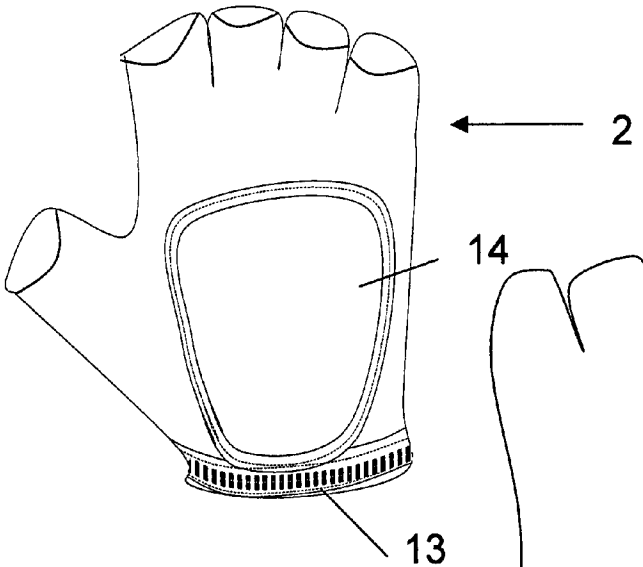
FIG. 4. Palm view of cycling glove showing wrist zipper

In FIG. 1 is glove 1 as viewed from the palm or bottom showing pocket 10 that is positioned on the external surface of the glove for holding padding. The pocket is held in place by stitches 11. Zipper gate 12 can be opened and the padding within the cavity of pocket 10 may be remove and replaced with the same or different padding. In FIG. 2 is glove 1 as seen from the top and shows zipper gate 12 and adjustable wrist band 15. In FIG. 3 is a side view of glove 1 and shows zipper gate 12 on the side. The zipper may be placed anywhere in the pocket and need not be limited to the side of the glove. For example in glove 2 of FIGS. 4-6B, zipper gate 13 for accessing pocket 14 is located near the wrist. For illustration, zipper gate 13 in FIGS. 6A and 6B is open to exposes single cavity 14*a* in FIG. 6A and two cavities 14*b* and 14*c* in FIG. 6B. When a glove has more than one cavity or pocket, more than one access point or gate can be installed.

Figure 9:
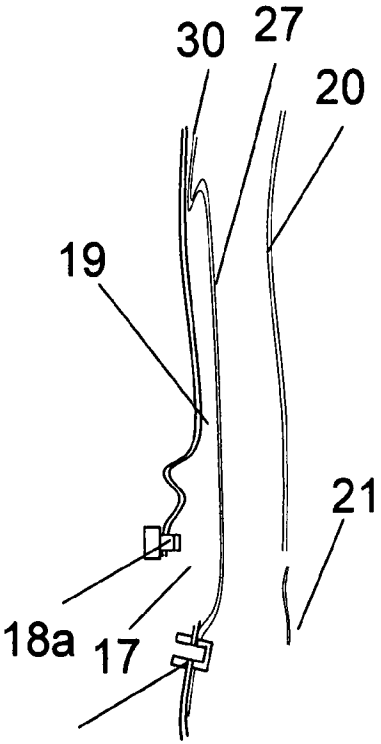
FIG. 9. Cross-sectional side view showing pocket and gate
Figure 8:
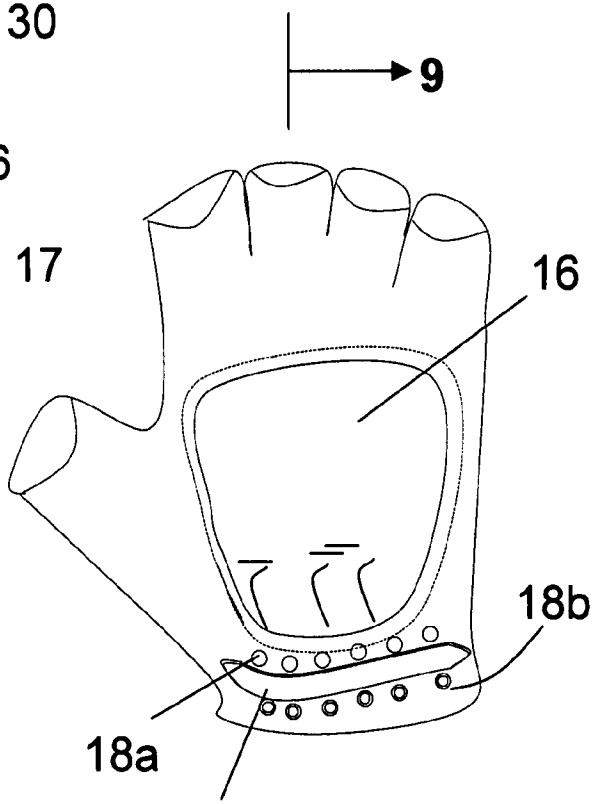
FIG. 8. Palm view showing open pocket gate
Figure 7:
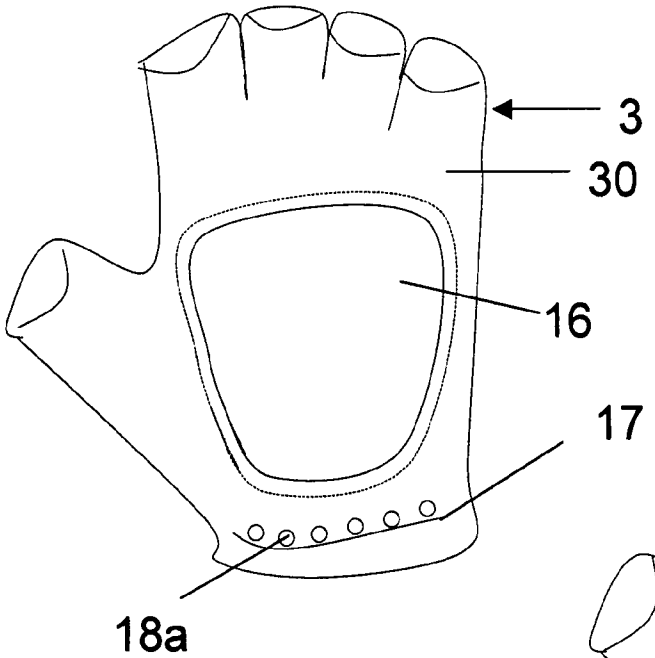
FIG. 7. Palm view of glove showing snap fasteners

In FIGS. 7-9 is glove 3 with pocket 16 positioned internal to the bottom material 30. Access to cavity 19 of pocket 16 is through gate 17 which is bridged by snaps 18*a* and 18*b* that securely hold gate 17 closed when fastened. Buttons, clips, Velcro® or other fastening material may be used instead of snaps 18*a* and 18*b*. In FIG. 8 snaps 18*a* and 18*b* are unfastened and gate 17 is gapping. The cross-sectional view of glove 3 in FIG. 9 shows pocket cavity 19, gate 17, and pocket wall 27 that faces the palm surface of the hand. Cavity 19 of pocket 16 is empty and pocket wall 27 is bulging inward towards surface 20, the top of the glove. Gate 17 is positioned so that clip 18*b* is not in direct line with wrist band 21 so as to prevent irritation to the wrist.

Figure 11:
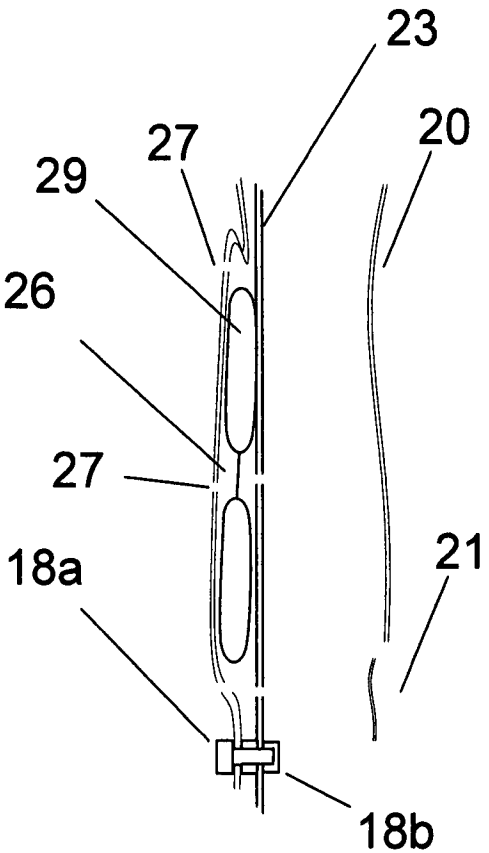
FIG. 11. Cross-sectional side view showing padding in pocket and ventilation ports FIG. 12. Palm view of glove having an internal pocket FIG. 13. Cross-sectional view showing internal pocket with padding FIG. 14. Cut-away view showing padding and tension cord FIG. 15. Cross-section view showing internal pocket, padding and cord FIG. 16. Palm view of glove with folding pocket gate FIG. 17. Cross-section of glove showing folding pocket gate FIG. 18. Palm view of glove with folding gate of separate material FIG. 19. Cross-sectional view of folding gate of separate material FIG. 20. Cut-away view of glove showing pocket FIG. 21. Cut-away view showing retracted palm material layer and folding gate FIG. 22. Cut-away view showing padding within pocket FIG. 23. Cut-away palm view showing padding FIG. 24. Cut-away palm view showing access opening of folding gate FIG. 25. Cut-away palm view showing top layer of the hand space FIG. 26. Inverted glove view showing folding gate during padding insertion FIG. 27. Palm view of glove with a folding pocket FIG. 28. Cross-sectional view of FIG. 27 showing folding pocket of glove 9
Figure 10:
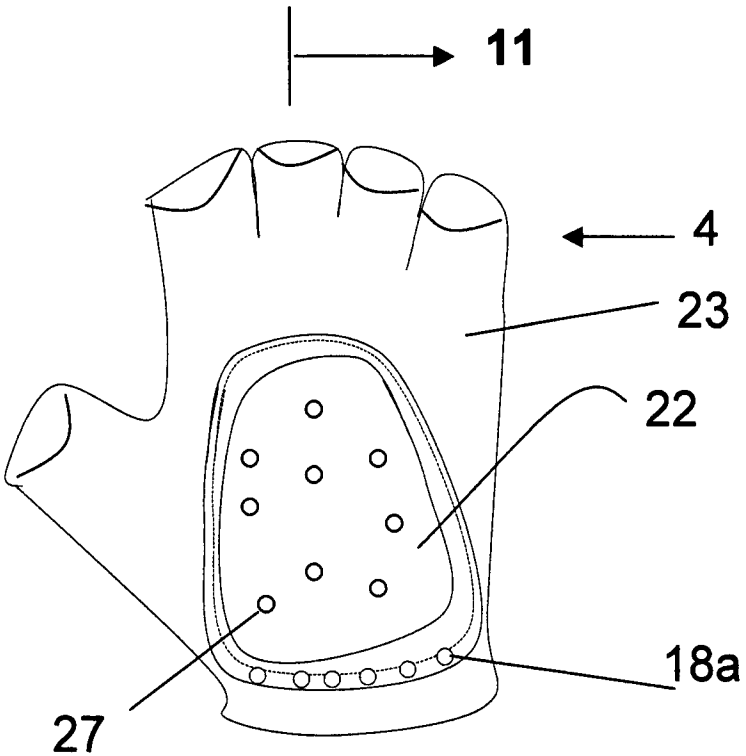
FIG. 10. Palm view of glove showing ventilation ports

In FIG. 10 pocket 22 is external to the bottom material 23 of glove 4 as can be seen in cross-sectional view of FIG. 11. Pocket cavity 26 in FIG. 11 is filled with padding 29 made up of two interconnection cushions. Also seen in FIGS. 10 and 11 are ventilation port 27 which provides for skin moisture to escape.

Figure 12:
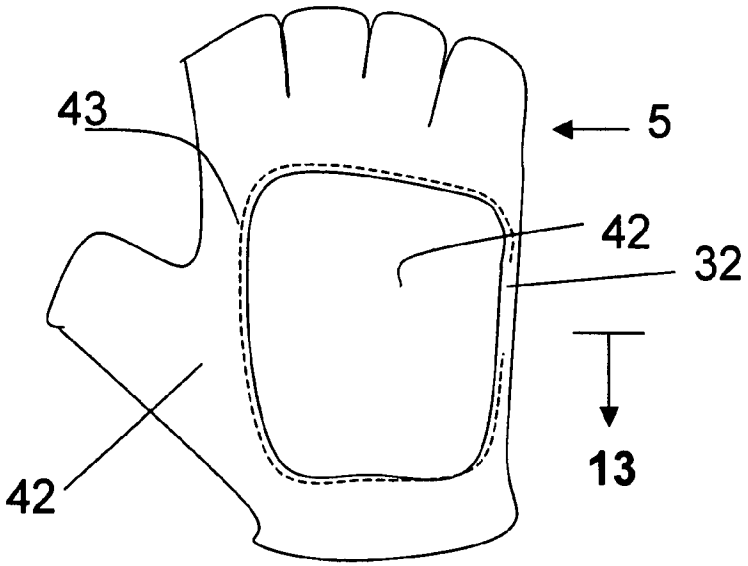
Figure 13:
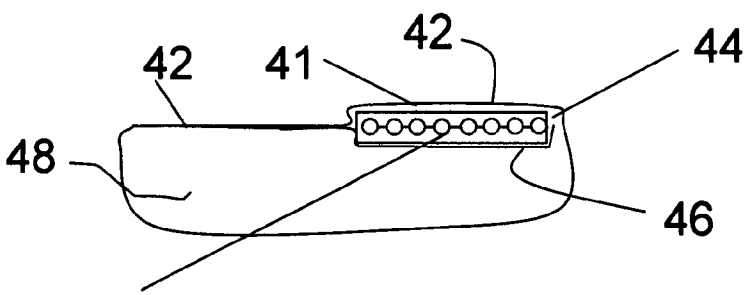

Another embodiment is seen in FIGS. 12 and 13 in glove 5 having pocket 41 interior to bottom material 42 and with pocket 41 attached by stitches 43. Pocket gate 44 allows insertion of padding 47 from within hand cavity 48. The size of gap 32 in stitches 43 is the length of pocket gate 44.

Figure 14:
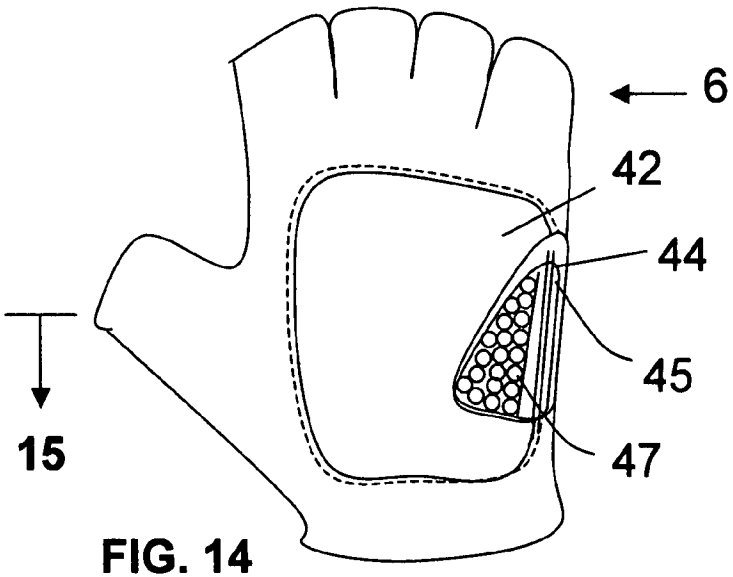
Figure 15:
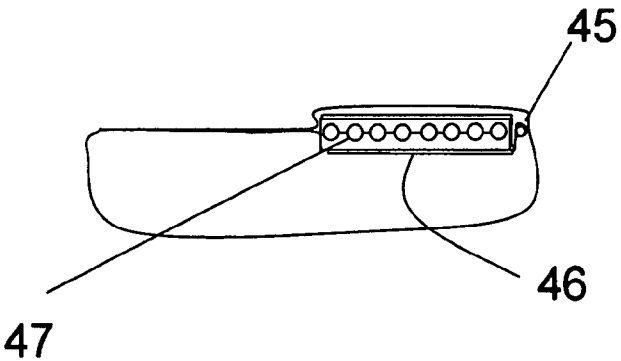
Figure 16:
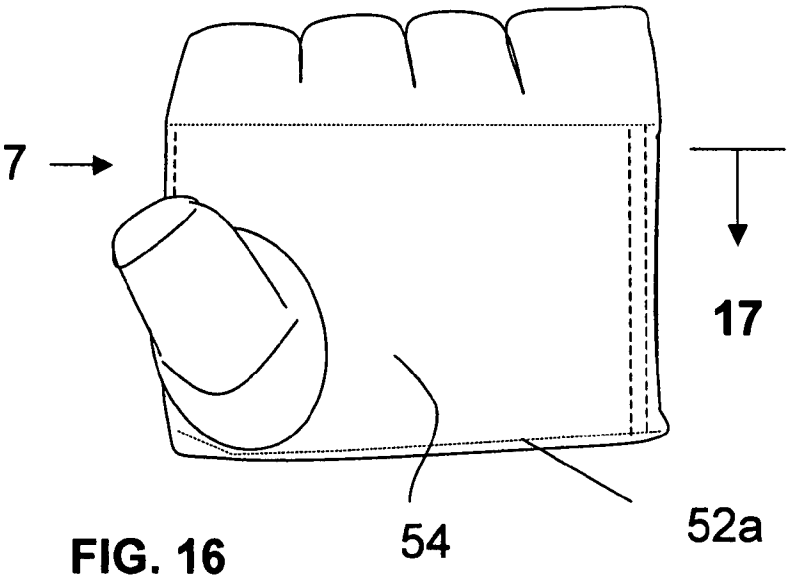

Yet another embodiment is glove 6 illustrated in FIGS. 14 and 15. Glove 6 differs from glove 5 by cord 45 which attaches to pocket material layer 46 at gate opening 44 and is anchored to palm side material layer 42 at the finger and wrist areas. In FIG. 14 the cut-away view shows the edge of padding 47, gate 44 and cord 45. FIG. 15 in cross-sectional view shows cord 45 between padding 47 and the side of the palm side material layer (42) of the glove. Cord 45 is made of monofilament nylon or other strong material that lends rigidity and integrity to gate 44 to keep padding 47 within pocket 41.

Figure 18:
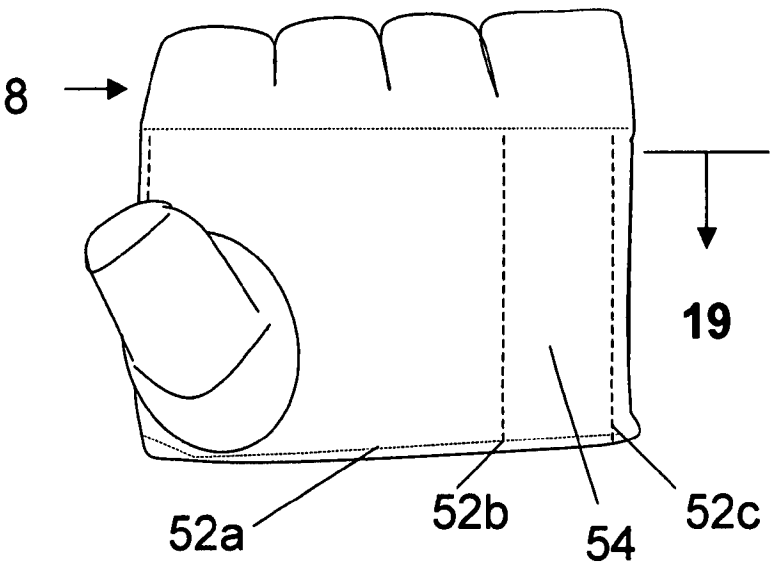
Figure 17:
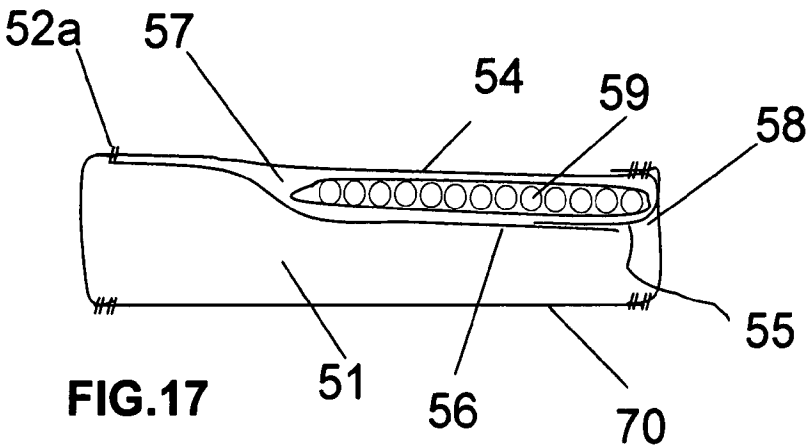
Figure 19:
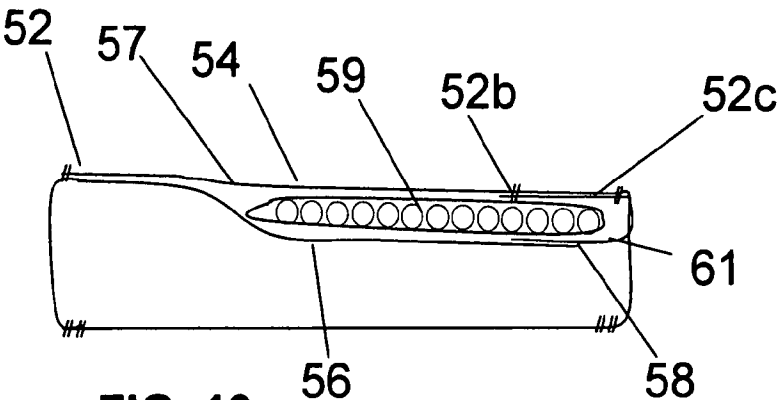
Figure 26:
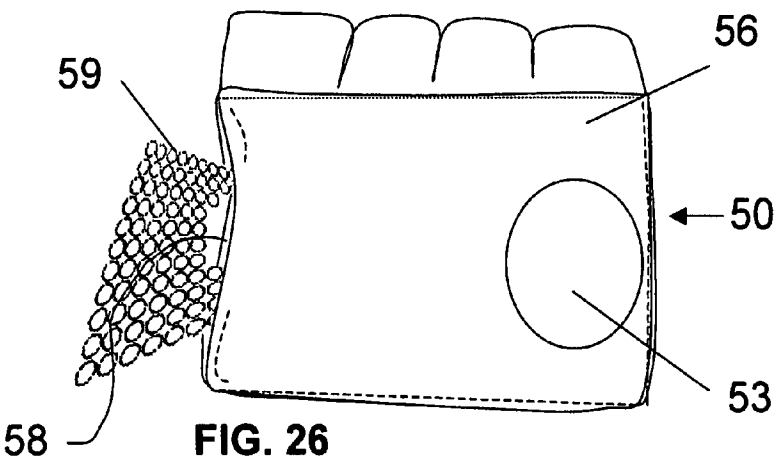
Figure 27:
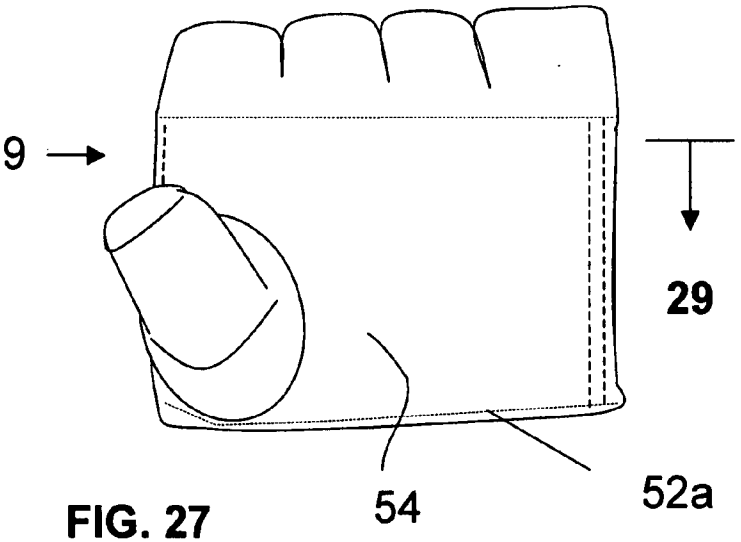
Figure 28:
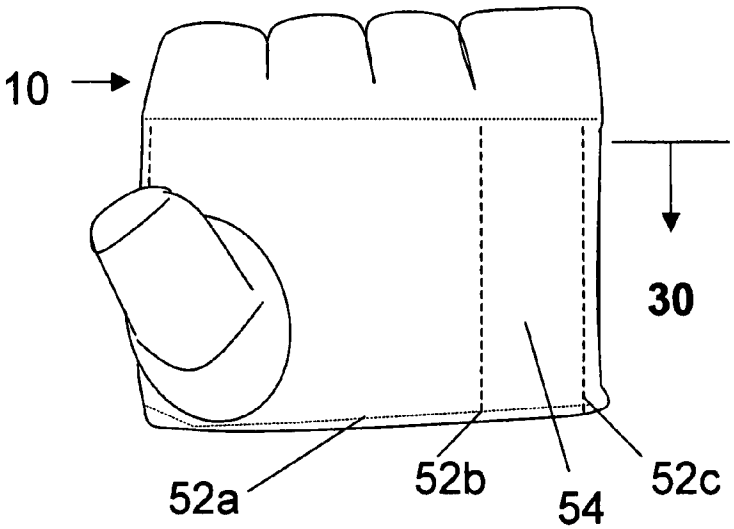
Figure 29:
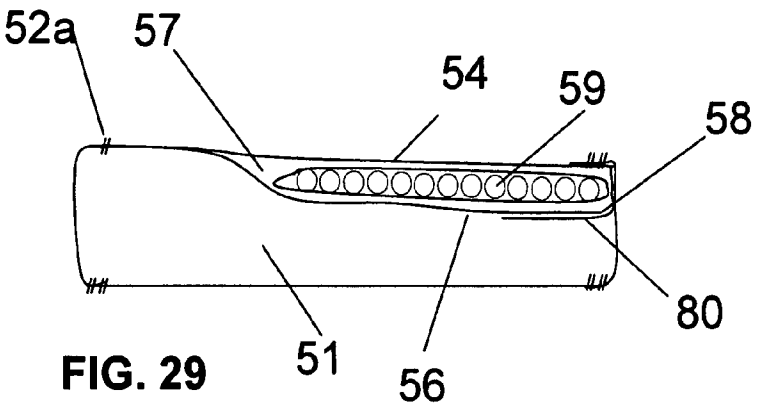
FIG. 29. Palm view of glove with separate material folding pocket
Figure 30:
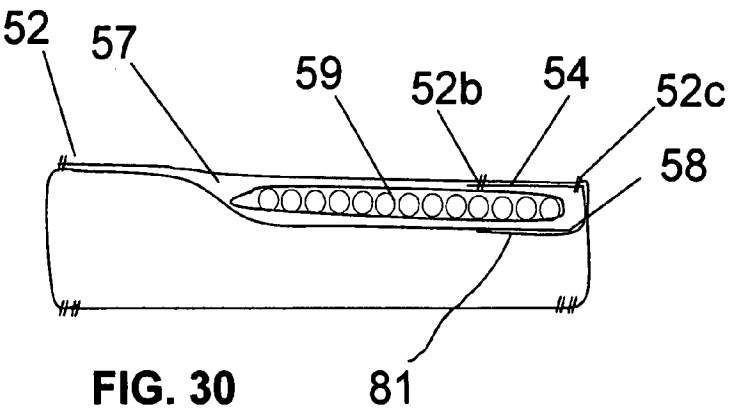
FIG. 30. Cross-sectional view of FIG. 28 showing folding pocket of glove 10

The preferred embodiment is illustrated in FIGS. 16-22. The key feature of glove 7 illustrated in FIG. 17 is retaining flap 55 which is developed by folding surface material 54 internally to form retaining flap 55 that closes pocket 57 in order to prevent pad 59 from falling into cavity 51. Flap 55 rests on material 56 that lines the palm surface of hand cavity 51. Access to pocket cavity 57 is through the gate 58, the potential space between flap 55 and material 56. In FIGS. 18 and 19 is glove 8 that differs from glove 7 by retaining flap 61 which is formed by arching material 61 over the padding within cavity 57. Flap 61 of glove 8 is a separate piece of material and not a continuation of bottom material 54 as is flap 55 of glove 7. Flap 61 is held in position by stitches 52*a*, 52*b* and 52*c*. To access gate 58, the glove is turned inside-out as illustrated in FIG. 26. When viewed from inside pocket 57, flaps 55 and 61 are proximal to palm material 56.

Figure 21:
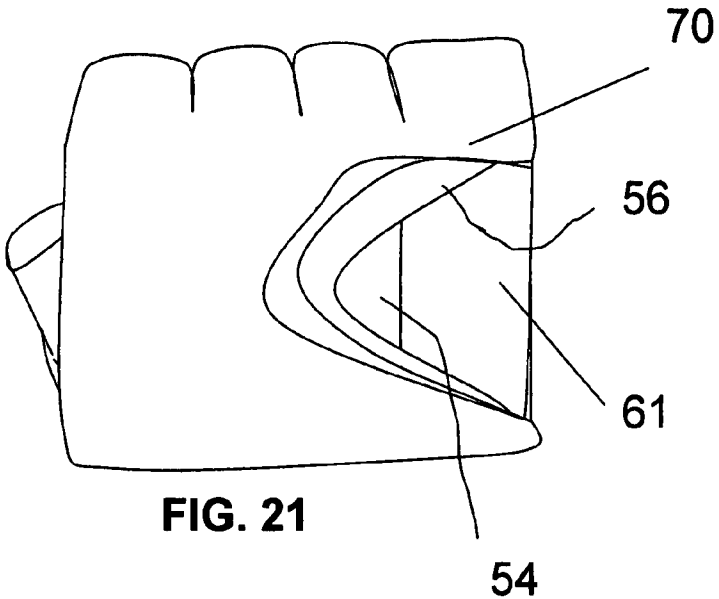
Figure 20:
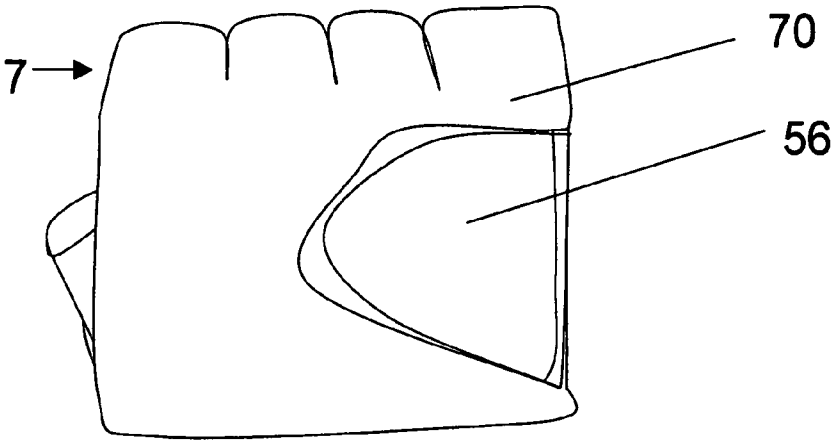
Figure 22:
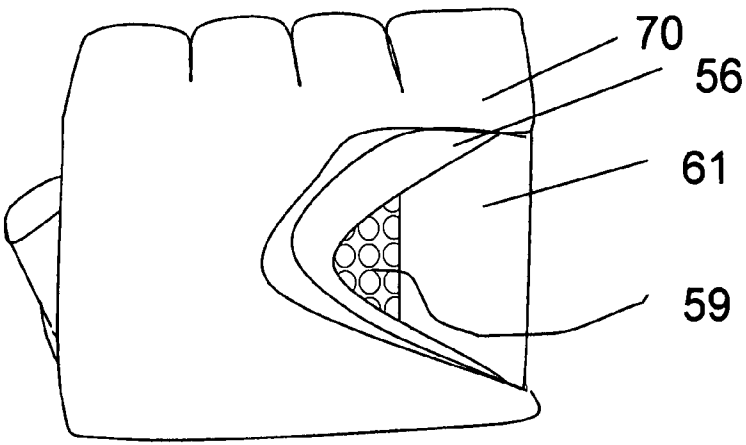

FIGS. 20-22 show cut-away illustrations as viewed from the top surface of glove 7. FIG. 20 shows top material 70 and the cut-away reveals palm material 56 that lines the palm surface of hand cavity 51 illustrated in FIG. 17. Hand cavity 51 separates material 70 from material 56. Using flap 61 as an example of the positioning of flaps 55 and 61, cut-out views from top of glove 7 as seen in FIGS. 20-22 illustrate flap 61 below palm material 56. In FIG. 22 glove 7 is shown with padding 59 and flap 61 is seen below palm material 56 and padding 59 is seen below flap 61.

Figure 23:
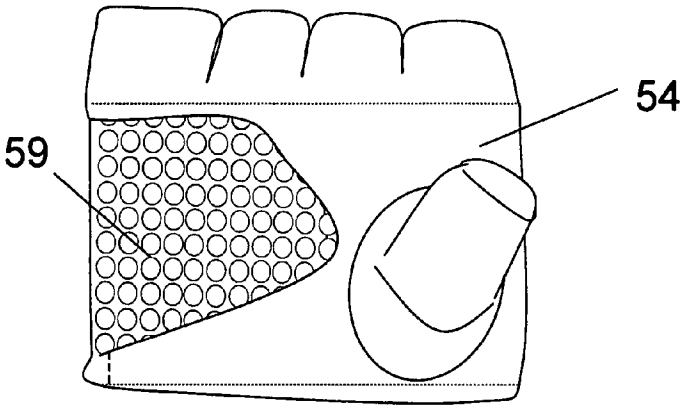
Figure 24:
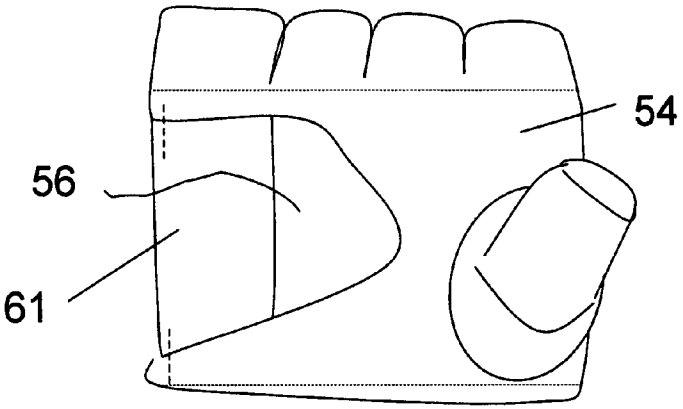
Figure 25:
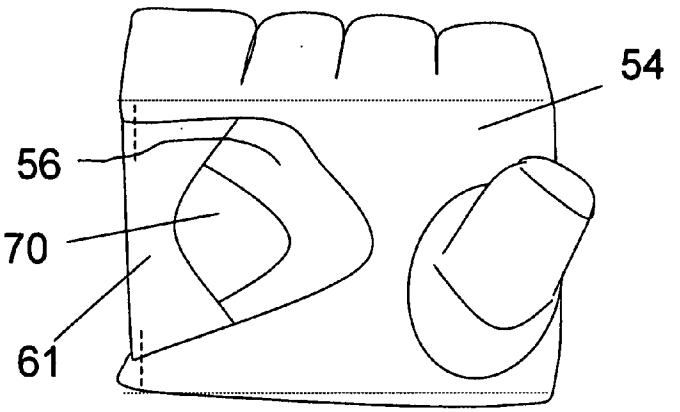

FIGS. 23-26 show cut-out illustrations as viewed from the bottom of glove 7. In FIG. 23, bottom material 54 is cut-away and the layer immediately next is padding 59. FIG. 24 is without padding and the cut-away view exposes flap 61 and material 56 that lines the palm surface of hand cavity 51. FIG. 25 is without padding and by retracting flap 61 and palm layer 56 material 70 that forms the top layer of glove 7 is revealed. In FIG. 26 is illustrated glove 7 turned inside-out and exposing palm surface material 56, thumb opening 53, and padding pocket opening 58. Padding 59 is shown folded to allow passage through opening 58 and into pocket cavity 57.

Figure 32:
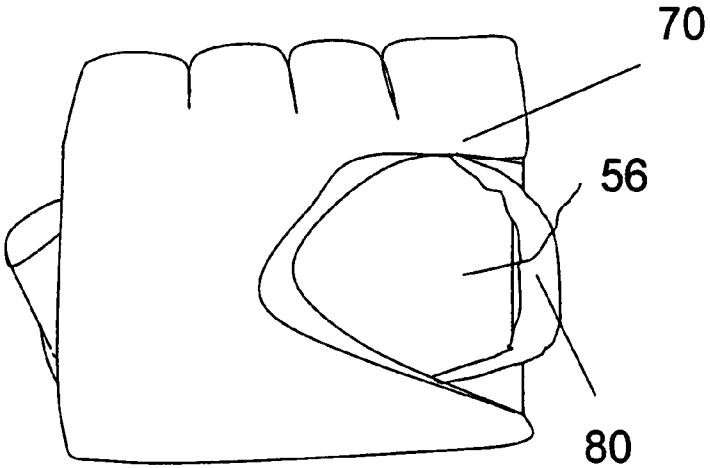
FIG. 32. Cut-away view of the top of glove showing layers of the pocket
Figure 33:
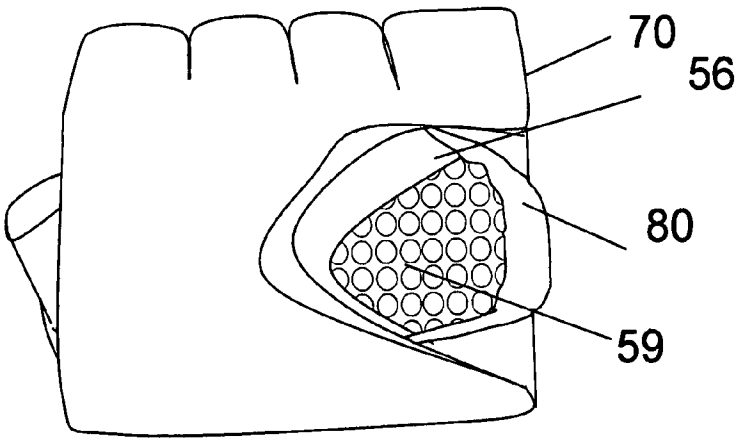
FIG. 33. Cut-away view of the top of glove showing layers of the pocket and padding
Figure 31:
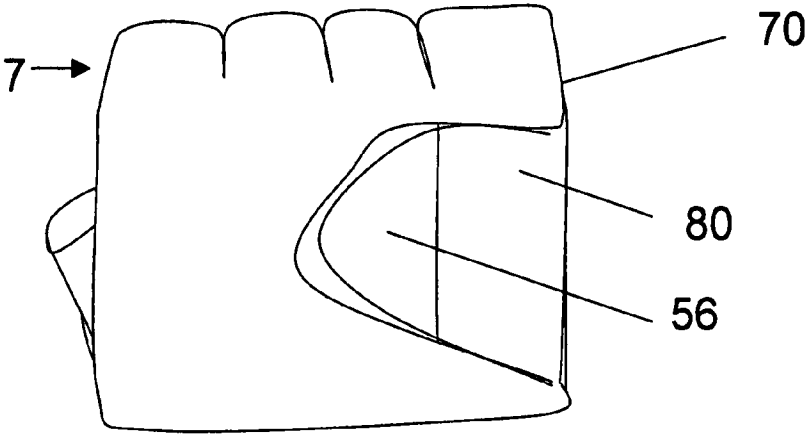
FIG. 31. Cut-away view of the top of glove showing pocket and folding gate

In another embodiment illustrated by gloves 9 and 10 in FIGS. 27-33, flap 80 and flap 81 are located distal to palm material 56 as viewed from within pocket 57. In cross-section view of FIG. 29, flap 80 is below palm material 56 and in cross-section view of FIG. 30, flap 81 is below palm layer 56. Using flap 80 as an example of the positioning of flaps 80 and 81, cut-out views from top of glove 9 as seen in FIGS. 31-33 illustrate flap 80 above palm material 56. In FIG. 33 glove 9 is shown with padding 59 to illustrate the relationship of padding 59 to palm material 56 and flap 80; padding 59 is below palm material 56 and palm material 56 is below flap 80.

What is claimed is:

1. A glove comprising;

A top side,

A palm side;

said palm side located opposite from said top side, said palm side comprising a material layer;

A pocket;

said pocket comprising a material layer stitched to an internal surface of said palm side material layer, A cushioning material;

Said cushioning material removably located within said pocket between said pocket material layer and said palm side material layer, and said cushioning material is removable through a gate opening in a side of said pocket, Said gate opening is provided with a closure;

said closure comprising a cord of monofilament nylon, said cord provides rigidity and maintains said cushioning material within said pocket, said cord is attached to said pocket at said gate opening and is anchored to a finger area and a wrist area of said palm side material layer, when said cushioning material is inserted into said pocket, said cord is located between said cushioning material and said palm side material layer.

* * * * *